US007692642B2

(12) United States Patent
Wyatt

(10) Patent No.: US 7,692,642 B2
(45) Date of Patent: Apr. 6, 2010

(54) METHOD AND APPARATUS FOR CONTROLLING DISPLAY REFRESH

(75) Inventor: David A. Wyatt, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 1042 days.

(21) Appl. No.: 11/027,113

(22) Filed: Dec. 30, 2004

(65) Prior Publication Data

US 2006/0146056 A1 Jul. 6, 2006

(51) Int. Cl.
*G09G 5/00* (2006.01)
*G09G 3/36* (2006.01)

(52) U.S. Cl. ..... 345/211; 345/214; 345/99

(58) Field of Classification Search ..... 345/501, 345/211–214, 204, 99; 713/300, 320, 322, 713/501, 500
See application file for complete search history.

(56) References Cited

U.S. PATENT DOCUMENTS 4,800,431 A * 1/1989 Deering ..... 348/719
5,446,496 A * 8/1995 Foster et al. ..... 348/441
5,576,738 A * 11/1996 Anwyl et al. ..... 345/212
5,757,365 A 5/1998 Ho
5,991,883 A * 11/1999 Atkinson ..... 713/300
6,262,695 B1 * 7/2001 McGowan ..... 345/1.1
6,678,834 B1 * 1/2004 Aihara et al. ..... 713/501
6,801,811 B2 * 10/2004 Ranganathan et al. ..... 700/22
2002/0015104 A1 2/2002 Itoh et al.
2003/0135288 A1 7/2003 Ranganathan et al.
2004/0125099 A1 7/2004 Stanley et al.
2005/0068289 A1 3/2005 Diefenbaugh

OTHER PUBLICATIONS

Notification of Transmittal of the International Search Report and the Written Opinion of the International Searching Authority, or the Declaration, mailed Nov. 23, 2006, International Application No. PCT/US2005/046848.

* cited by examiner

*Primary Examiner*—Joni Hsu
(74) *Attorney, Agent, or Firm*—Kacvinsky LLC

(57) ABSTRACT

An approach for dynamic refresh rate control. For one aspect, a policy, such as a power, performance, quality or other policy, for example, is accessed. A refresh rate may then be dynamically selected in response to detected display content activity and policy preferences for displays that are regularly refreshed. Alternatively, if the display is one of a bi-stable, a self-refreshing display or another type of display that is refreshed irregularly, whether or not to refresh the display may be determined based on detected content activity.

20 Claims, 14 Drawing Sheets

METHOD AND APPARATUS FOR CONTROLLING DISPLAY REFRESH

BACKGROUND

An embodiment of the present invention relates to the field of displays and, more particularly, to controlling display refresh.

Most current LCD displays have innate limits in the response time of the active pixel element. Such displays typically cannot switch black to full color at faster than 40 Hz. Thus, the impact of limiting the refresh rate is less noticeable than on other types of display technologies.

While this is the case, most notebook computing systems continuously operate at 60 Hz refresh rate, and, in some cases, 50 Hz. These refresh rates may result in unnecessary power consumption in the display panel, the graphics controller and/or in the graphics memory (or system memory for integrated graphics).

BRIEF DESCRIPTION OF THE DRAWINGS

The present invention is illustrated by way of example and not limitation in the figures of the accompanying drawings in which like references indicate similar elements, and in which.

DETAILED DESCRIPTION

Figure 1:
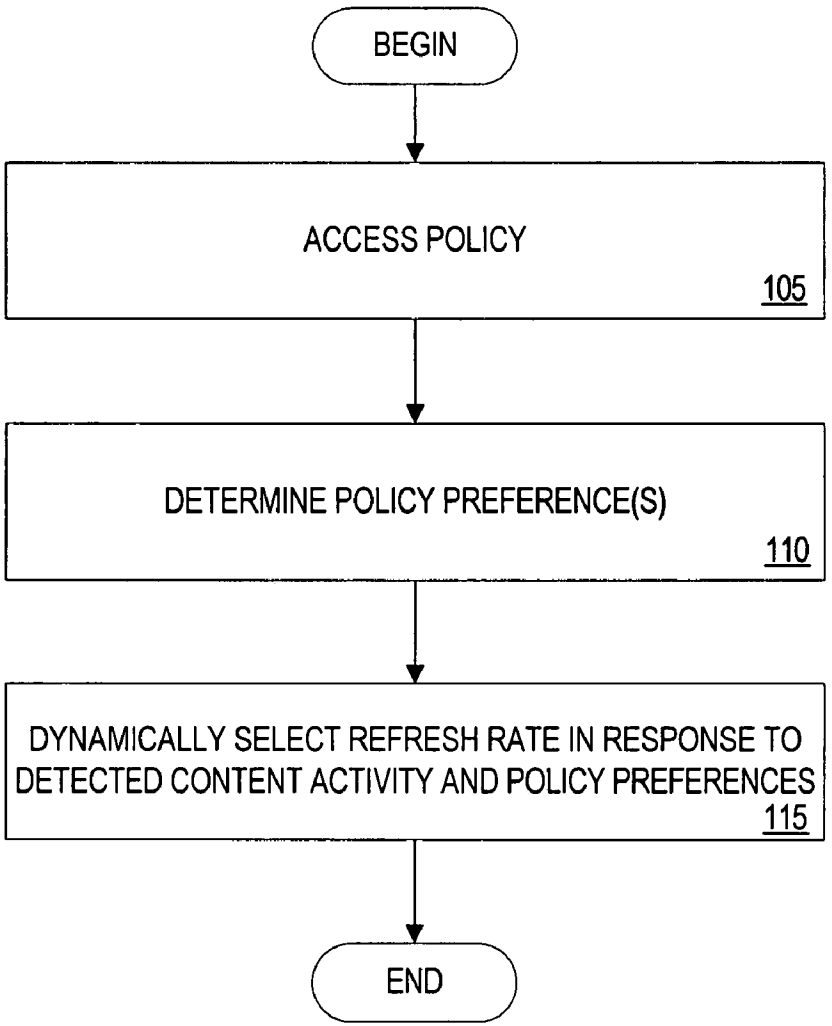
FIG. 1 is a flow diagram showing a method of one embodiment for dynamically changing a display refresh rate.

A method, apparatus and system for controlling display refresh are described. In the following description, particular software modules, components, systems, display types, etc. are described for purposes of illustration. It will be appreciated, however, that other embodiments are applicable to other types of software modules, components, systems and/or display types, for example.

References to "one embodiment," "an embodiment," "example embodiment," "various embodiments," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

Embodiments of the invention may be implemented in one or a combination of hardware, firmware, and software. Embodiments of the invention may also be implemented in whole or in part as instructions stored on a machine-readable medium, which may be read and executed by at least one processor to perform the operations described herein. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other form of propagated signals (e.g., carrier waves, infrared signals, digital signals, etc.), and others.

Electronic system power, for systems including a display, may be affected by the display refresh frequency. Lower refresh frequencies may have a corresponding effect in reducing overall system power for a variety of reasons. For example, where used, thin film transistor (TFT) liquid crystal display (LCD) devices have active pixel transistors that store charge at a switch rate proportional to the display refresh rate. Additionally, the graphics controller to display interface (e.g. LVDS (Low Voltage Differential Signaling) or TMDS (Transition Minimized Differential Signaling)) signals at a rate proportional to the display refresh rate.

Further, the graphics controller processes pixels in the display blending pipeline and image pixels from graphics memory at a rate proportional to the display refresh rate. Similarly, graphics memory drives image pixel data onto the memory data bus at a rate proportional to the display refresh rate. Applications that are synchronizing content to display refresh rate (in order to provide a seamless, tear-free visual experience) will typically process content and command the graphics controller to render content at a rate proportional to the display refresh rate.

For some usage models (e.g. for Video or 3D, for example), higher content display rates are desirable to create improved visual quality. For such usage models, it is anticipated that, whenever possible or desired, as expressed through system policies, that the system should attempt to achieve maximum quality. In contrast, for some usage models, battery life may be more important than visual quality. For this scenario, lower refresh rates may be a desirable power conservation tactic for the graphics driver.

For one embodiment, referring to FIG. 1, a policy is accessed at block 105. The policy may be one of a set of policies that relate to a particular usage model or set of operating conditions, for example, and may specify preferences, such as performance, quality, power savings and/or extended battery life, for example, that may be used to control operating conditions and/or other parameters. At block 110, policy preference(s) are determined. At block 115, for displays that are refreshed continuously, a refresh rate may then be dynamically selected in response to detected display content activity and policy preference(s). For example, if a policy preference is for power savings or battery life, display refresh rates may tend to be adjusted downwards. If a policy preference is for display quality, however, display refresh rates may tend to be adjusted upwards For displays that are refreshed irregularly, a refresh may be initiated in response to detected content activity exceeding or extending below a content activity threshold. Further details of these and other embodiments are provided in the following description.

Figure 2:
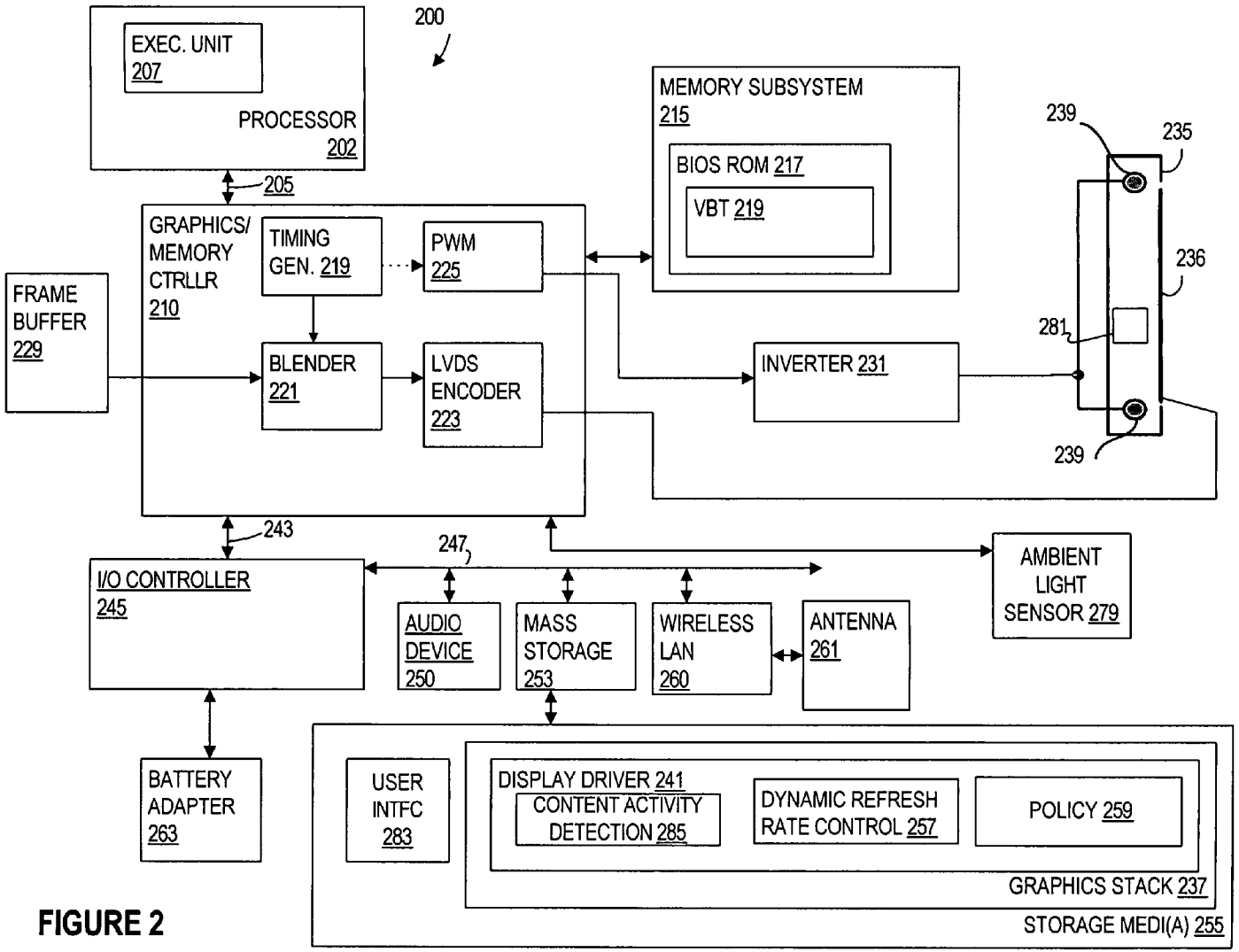
FIG. 2 is a block diagram of an example system in which one embodiment of the dynamic refresh rate adjustment approach of one or more embodiments may be implemented.

FIG. 2 is a block diagram of an example electronic system 200 that may advantageously implement the approaches of one or more embodiments for dynamically adjusting a display refresh rate. While the example system of FIG. 2 is a laptop or notebook computing system, it will be appreciated that one or more of the refresh rate management approaches described herein may be applied to many different types of electronic systems with an associated display device. Examples of such systems include, but are not limited to, personal digital assistants (PDAs), palm top computers, notebook computers, tablet computers, desktop computers using flat panel displays, wireless phones, kiosk displays, etc.

The computing system 200 includes a processor 202 coupled to a bus 205, which may be, for example, a point-to-point bus, a multi-drop bus, a switched fabric or another type of bus. The processor 202 includes at least a first execution unit 207 to execute instructions that may be stored in one or more storage devices in the system 200 or that are otherwise accessible by the system 200. The processor 202 may be a single- or multi-core processor.

For one embodiment, the processor 202 may be a processor from the Pentium® family of processors such as, for example, a processor from the Pentium-M family of processors available from Intel® Corporation of Santa Clara, Calif. Alternatively, a different type of processor and/or a processor from a different source and/or using a different architecture may be used instead or in addition to the above-described processor. Other types of processors that may be used for various embodiments include, for example, a digital signal processor, an embedded processor or a graphics processor.

A memory controller 210, or north bridge, is also coupled to the bus 205. The memory controller 210 may or may not include integrated graphics control capabilities for some embodiments, and is coupled to a memory subsystem 215. The memory subsystem 215 is provided to store data and instructions to be executed by the processor 202 or another device included within the electronic system 200. For one embodiment, the memory subsystem 215 may include dynamic random access memory (DRAM). The memory subsystem 215 may, however, be implemented using other types of memory in addition to or in place of DRAM. For some embodiments, the memory subsystem 215 may also include BIOS (Basic Input/Output System) ROM 217 including a Video BIOS Table (VBT) 219. Additional and/or different devices not shown in FIG. 2 may also be included within the memory subsystem 215.

Also coupled to the memory controller 210 over a bus 243 is an input/output (I/O) controller 245, or south bridge, which provides an interface to input/output devices. The input/output controller 245 may be coupled to, for example, a Peripheral Component Interconnect (PCI™) or PCI Express™ bus 247 according to a PCI Specification such as Revision 2.1 (PCI) or 1.0a (PCI Express) promulgated by the PCI Special Interest Group of Portland, Oreg. For other embodiments one or more different types of buses such as, for example, an Accelerated Graphics Port (AGP) bus according to the AGP Specification, Revision 3.0 or another version, may additionally or alternatively be coupled to the input/output controller 245 or the bus 247 may be a different type of bus.

Coupled to the input/output bus 247 for one embodiment are an audio device 250 and a mass storage device 253, such as, for example, a disk drive, a compact disc (CD) drive, and/or a network device to enable the electronic system 200 to access a mass storage device over a network. An associated storage medium or media 255 is coupled to the mass storage device 253 to provide for storage of software and/or other information to be accessed by the system 200.

In addition to an operating system (not shown) and other system and/or application software, for example, the storage medium 255 may store a graphics stack 237 to provide graphics capabilities as described in more detail below. A display driver 241 may be included in the graphics stack 237. For one embodiment, the display driver 241 includes or works in cooperation with at least a refresh rate control module 257 and a policy module 259 described in more detail below. While the policy module 259 is shown in FIG. 2 as being part of the display driver 241, it will be appreciated that the policy module 259 may be provided by or stored in another module within the system 200 or accessible by the system 200. Other modules may also be included for other embodiments.

The system 200 may also include a wireless local area network (LAN) module 260 and/or an antenna 261 to provide for wireless communications. A battery or other alternative power source adapter 263 may also be provided to enable the system 200 to be powered other than by a conventional alternating current (AC) power source.

With continuing reference to FIG. 2, a display 235 may be coupled to the graphics/memory controller 210. For one embodiment, the display 235 is a local flat panel (LFP) display such as, for example, a thin film transistor (TFT) liquid crystal display (LCD). For other embodiments, the display 235 may be a different type of display such as, for example, a cathode ray tube (CRT) display or a Digital Visual Interface (DVI) display, or an LFP display using a different technology.

The memory controller 210 may further include graphics control capabilities. As part of the graphics control capabilities, a timing generator 219, display blender 221 and an encoder 223 may be provided. A frame buffer 229 may also be coupled to the graphics/memory controller.

Also associated with the LCD display 235 operation for some embodiments may be a pulse width modulator (PWM) 225, a high voltage inverter 231, and a cold cathode fluorescent lamp (CCFL) backlight 239. Other embodiments, however, may include alternate methods for providing backlight, including but not limited to, Electroluminescence Panel (ELP), Incandescent Light, or Light Emitting Diode (LED) or may not include a backlight.

Some embodiments may not require a PWM or high-voltage inverter, such as for Incandescent Light backlighting using direct drive DC current, or may include PWM and no inverter such as for LED backlighting. In various implementations, two or more of the elements discussed above may be integrated within a single device or in a different manner for other embodiments. For example, the pulse width modulator 225 may be integrated with the graphics controller, in a standalone component or integrated with the inverter 231. For such embodiments, the PWM 225/inverter 231 may be driven by software and coupled to either the graphics and memory control hub 210 or the I/O control hub 240. Further, the functionality of one or more of the graphics-related elements may be implemented in hardware, software, or some combination of hardware and software or in another component of the system 200.

The frame buffer 229, timing generator 219, display blender 221, and encoder 223 may cooperate to drive the panel 236 of the panel display 235. The frame buffer 229 may include a memory (not shown) and may be arranged to store one or more frames of graphics data to be displayed by the panel display 235.

The timing generator 219 may be arranged to generate a refresh signal to control the refresh rate (e.g. frequency of refresh) of the panel 236. The timing generator 219 may produce the refresh signal in response to a control signal from the display driver 241, possibly from the dynamic refresh rate control module 257. In some implementations, the refresh signal produced by the timing generator 219 may cause the panel 236 to be refreshed at a reference refresh rate (e.g. 60 Hz) during typical (e.g. non-power saving) operation. During power saving operation, the timing generator 219 may lower refresh rates for panel display 110 (e.g. to 50 Hz, 40 Hz, 30 Hz, etc.) as described in more detail below.

The display blender 221 may read graphics data (e.g. pixels) from the frame buffer 229 in graphics memory at the refresh rate specified by the refresh signal from the timing generator 219. The display blender 221 may blend this graphics data (e.g. display planes, sprites, cursor and overlay) and may also gamma correct the graphics data. The display blender 221 also may output the blended display data at the refresh rate. In one implementation, the display blender 221 may include a first-in first-out (FIFO) buffer to store the graphics data before transmission to the encoder 223.

The encoder 223 may encode the graphics data output by the display blender 221 for display on the panel 236. Where the panel 236 is an analog display, the encoder 223 may use a low voltage differential signaling (LVDS) scheme to drive the panel 236. For other implementations, if the panel 236 is a digital display, the encoder 223 may use another encoding scheme that is suitable for this type of display. Because the encoder 223 may receive data at the rate output by the display blender 221, the encoder may refresh the panel 236 at the refresh rate specified by the refresh signal from the timing generator 219.

It will be appreciated that systems according to various embodiments may not include all the elements described in reference to FIG. 2 and/or may include elements not shown in FIG. 2. For example, for some embodiments, an ambient light sensor (ALS) 279 and associated circuitry and/or software may be included.

For one embodiment, as mentioned above, if a policy, provided, for example, by the policy module 259, indicates a preference for extending battery life or otherwise reducing power consumption, then a refresh rate may be dynamically adjusted depending on detected content activity, which may be detected, for example, by a content activity detection module 285.

Figure 3:
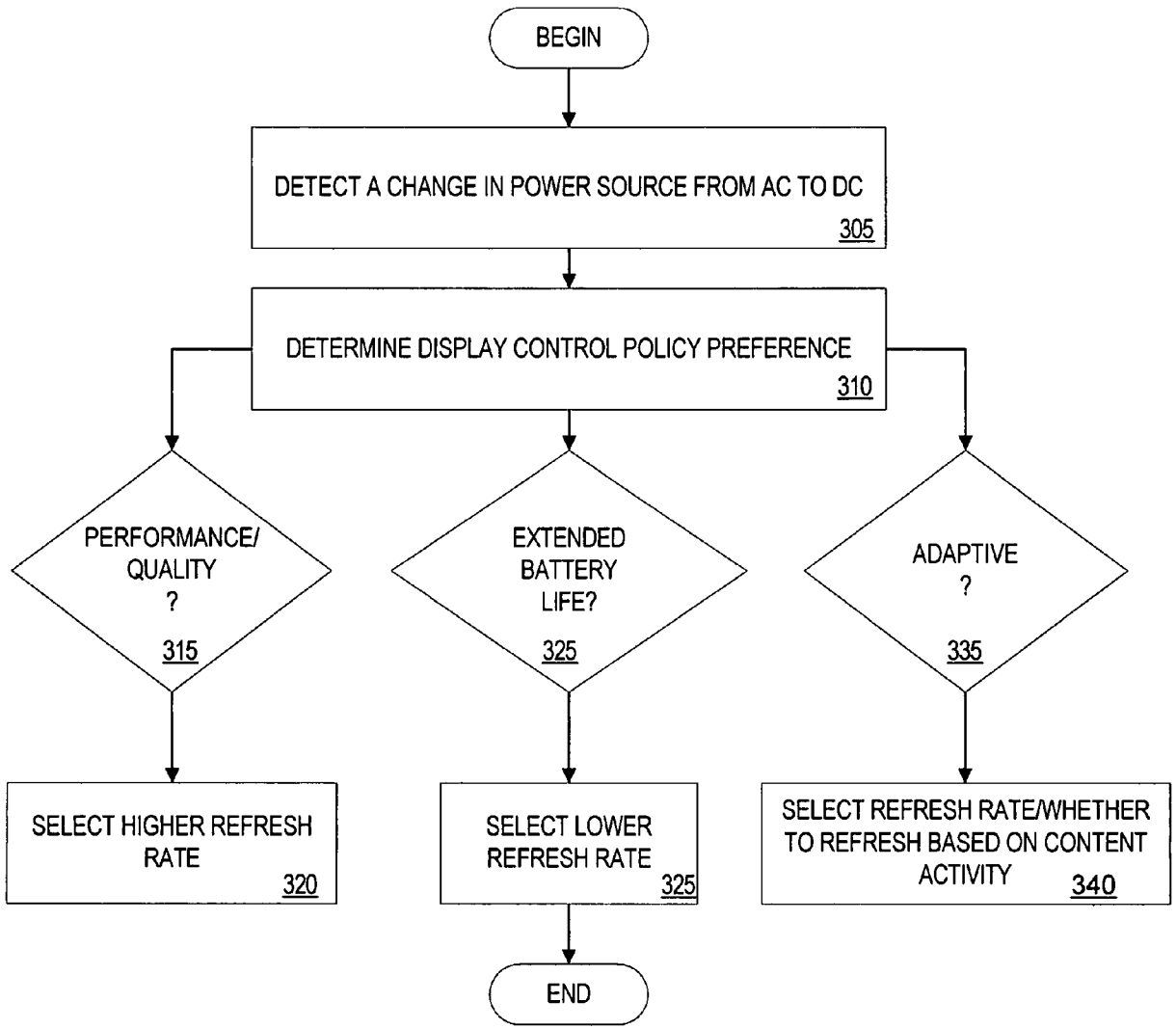
FIG. 3 is a flow diagram showing a method of one embodiment for dynamically changing a display refresh rate.

FIG. 3 is a flow diagram illustrating a method of one embodiment for dynamically controlling a display refresh rate. In response to, for example, detecting a change in power source from AC to DC (battery), detecting a period of system inactivity and/or occurrence of another condition at block 305, at block 310, a policy preference is accessed. The policy may be one or more policies relating specifically to display control or part of overall system policies relating to power consumption, performance, quality or battery life, for example.

For the system of FIG. 2, for example, the policy 259 of interest may be stored in software or firmware and/or may be provided as part of the graphics stack or one or more other modules. The policy 259 is accessible by the dynamic refresh rate control module 257, which may perform one or more of the refresh rate control functions described herein.

The policy may be set by a system manufacturer or via an operating system for one embodiment. For another embodiment, the policy or policies that determine how the display refresh may be controlled may vary according to the application(s) being executed by the system 200 or according to user preference, which may be specified through a user interface 283. The user interface 283 may be provided as part of an operating system or other software (not shown) for example. The policy or policies of interest may be provided and/or set in a different manner for other embodiments.

Referring back to FIG. 3, if the policy/policies indicates a preference for performance and/or display quality (block 315), for example, then at block 320, for displays that are regularly refreshed, one of the higher available refresh rates (e.g. 60 Hz or 50 Hz for a typical laptop display) may be selected. If instead, at block 325, a preference for extended battery life is indicated, then at block 330, a lower refresh rate may be selected (e.g. 60 Hz interlaced or 40 Hz for a typical laptop display) over a higher refresh rate.

Figure 4:
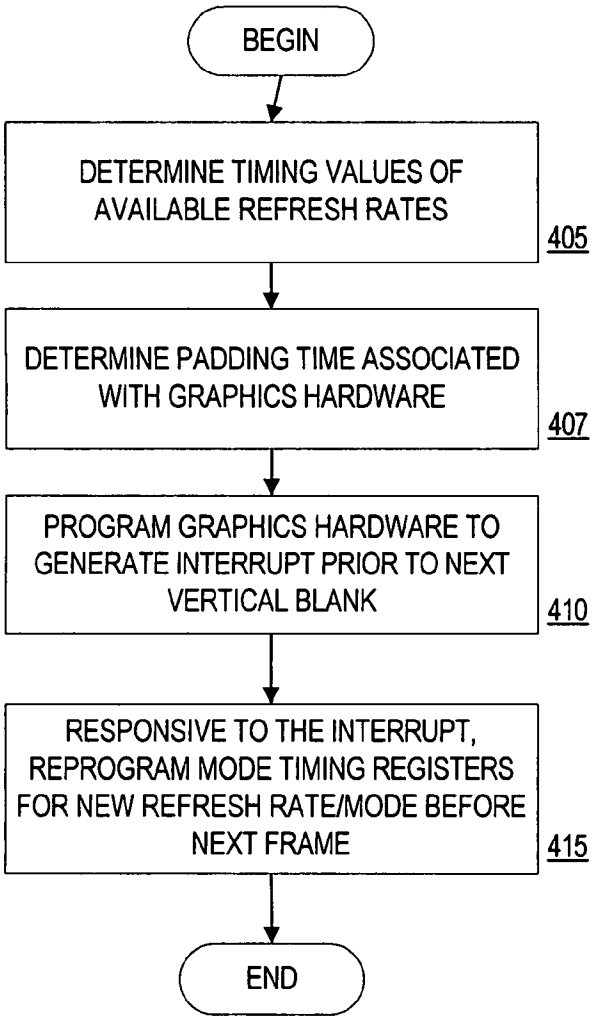
FIG. 4 is a flow diagram showing a method of one embodiment for dynamically implementing a new refresh rate or mode.

FIG. 4 is a flow diagram showing an example embodiment of a method for dynamically adjusting the refresh rate if it is determined that the refresh rate is to be adjusted at either block 320 or 330 of FIG. 3. At block 405, the timing values associated with the available refresh rates may be determined from, for example, detailed timing descriptor (DTD) fields of Extended Display Identification Data (EDID) as defined, for example, in the CPIS (Common Panel Interface Specification) specification or in another manner. Referring to FIG. 2, the EDID 281 may be provided with the display 236, for some embodiments. For other embodiments, similar information indicating available refresh rates and associated timing values may be provided in other manner, e.g. embedded in firmware to be accessed by the graphics driver.

Depending on the particular system and display features, characteristics and capabilities, a variety of different refresh rates may be available. For example, for some systems, the available refresh rates may include different rates and/or may include different types of refresh modes at one or more different rates.

Examples of different types of refresh modes that may be supported include progressive and/or interlaced timings. For interlaced scanning, two or more alternating fields of interlaced lines are displayed per frame, e.g. 60 Hz interlace is approximately equivalent to 30 Hz progressive. Other refresh modes, such as bi-stable and/or self-refreshing modes, may also or alternatively be supported. For a bi-stable or self-refreshing mode, a display may statically hold pixel information without requiring continuous display refresh. Application of the refresh control approach of one or more embodiments as applied to displays capable of such refresh modes are discussed in more detail below.

Figure 5:
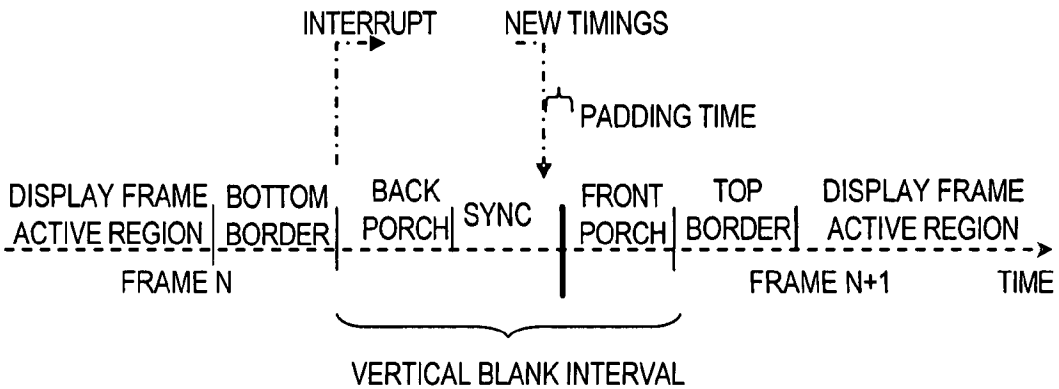
FIG. 5 is a timing diagram illustrating example timings for one embodiment for dynamically changing display refresh rates.

Referring to FIGS. 4 and 5, after determining a padding time associated with the graphics hardware and/or a refresh mode at block 407, at block 410, the graphics hardware (e.g. a graphics controller either integrated into the chipset or provided separately) may be programmed to generate an interrupt prior to the next vertical blank to initiate the change. The interrupt may be generated prior to the vertical blank by at least the padding time. The padding time may allow for changing into pixel/line doubling mode, changing timing parameters (e.g front/back porch, sync, blank) while a pixel clock and active times are held constant and/or phase lock loop (PLL) settling time after a pixel clock is changed. Responsive to the interrupt, at block 415, the mode timing registers may be reprogrammed with the display clock speed and timing values determined at block 405 during the vertical blank and prior to the beginning of the next frame. In this manner, visual artifacts associated with changing the refresh rate at another time may be substantially avoided.

While the example timing of FIGS. 4 and 5 is described in reference to the vertical blanking interval, for other embodiments, a different timing may be used to substantially avoided. For example, changes may be implemented to take effect in a horizontal blanking interval or between scanlines, for example. Other approaches for substantially avoiding visually disturbing artifacts while adjusting a refresh rate are within the scope of various embodiments.

Referring back to FIG. 3, at block 335, if the policy is for adaptive control policies with a preference for extending battery life, then, for one embodiment, at block 340, the graphics may be dynamically changed from a lower refresh rate to a higher refresh rate and vice versa according to detected display content activity. Further, for displays that do not require continuous/regular refreshing, at block 335, whether or not to refresh may be determined based on display content activity.

Figure 6:
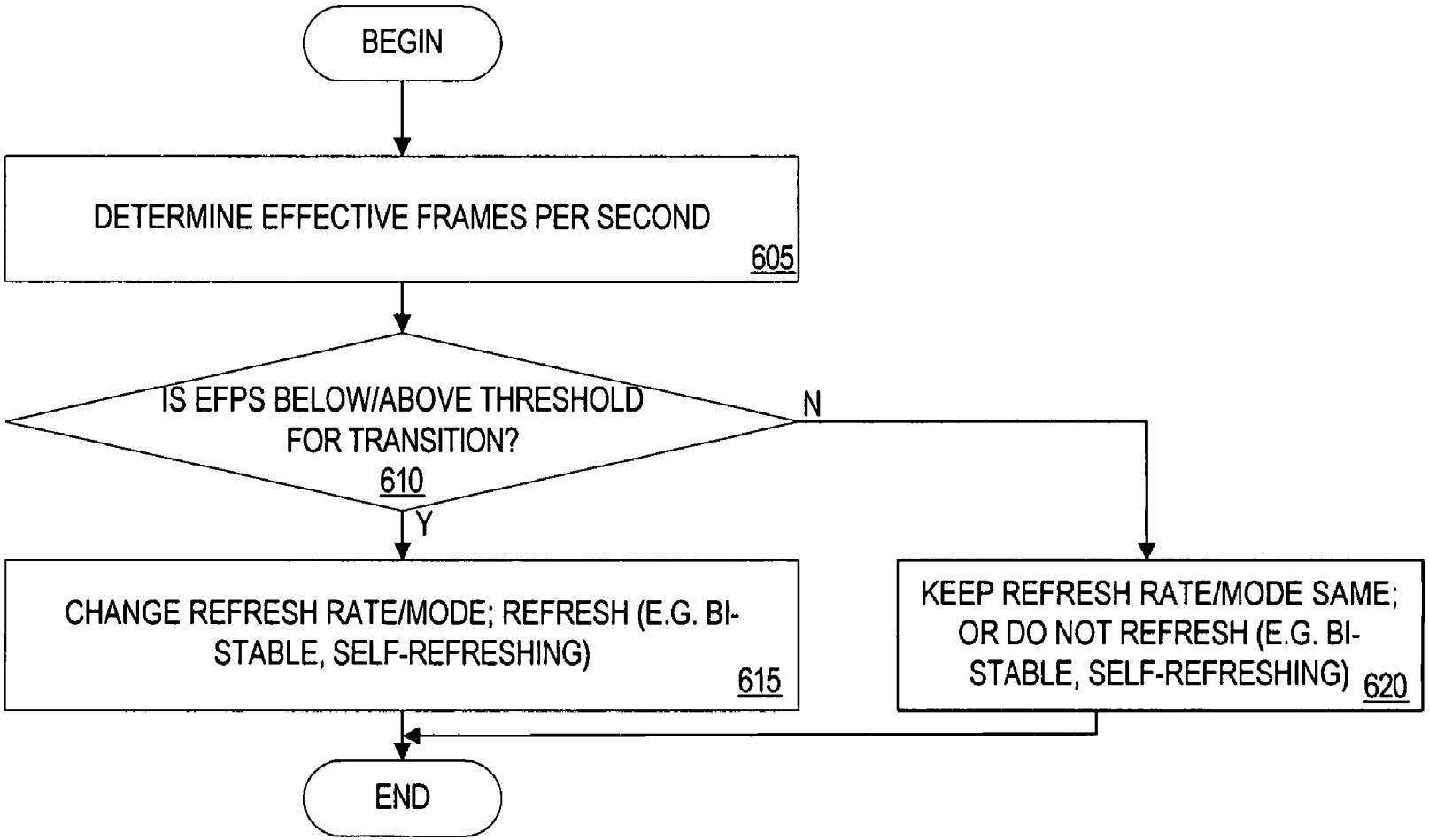
FIG. 6 is a flow diagram showing a method of one embodiment for detecting effective content activity.

FIG. 6 is a flow diagram showing an example approach that may be used for one embodiment to dynamically control a display refresh rate according to detected content activity. Referring to FIGS. 2 and 6, at block 605, at a high level, the graphics driver 241 may keep a running count of the number of present operations, e.g. overlay or display flips, and stretchBlts to primary surface, within a given sample window (e.g. 1 sec or less) to determine a moving average or effective frames per second (EFPS) associated with content flowing through graphics as described in more detail below. For one embodiment, this may be done using a content activity detector module 285 that is provided as part of the graphics driver 241.

For some content, the moving average or EFPS may be very consistent regardless of the amount of motion between frames. For other types of content, e.g. games with sync-on-refresh disabled, the rate may be entirely variable and may depend largely on the speed of the graphics geometry and renderer pipeline.

With continuing reference to FIGS. 2 and 6 and further to FIG. 7, at block 610, if the EFPS slows down to below a low threshold rate (e.g. n in FIG. 7), then, in response, the dynamic refresh control module 257 may switch the refresh rate down from a higher refresh rate Rm to a lower refresh rate mode Rn. While at the lower refresh rate Rn, if the EFPS is determined to exceed the high threshold rate (e.g. greater than m), then the driver will switch up to the higher refresh rate Rm. Additional modes may be supported with thresholds associated with each as shown in the example of FIG. 8.

Figure 7:
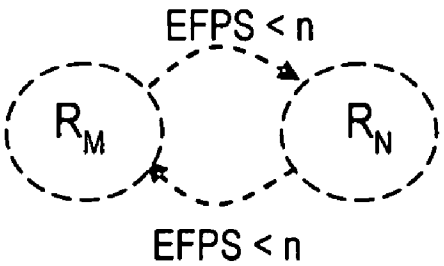
FIG. 7 is a state diagram illustrating example transitions between refresh rate modes for one embodiment.
Figure 8:
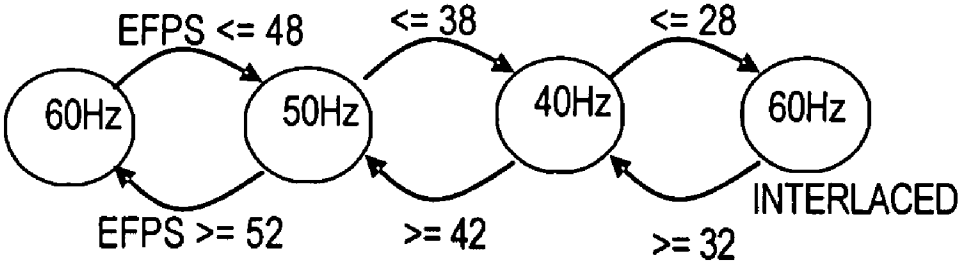
FIG. 8 is a state diagram illustrating example transitions between additional refresh rate modes for one embodiment.

For one embodiment, the thresholds m and n of FIG. 7 are different, and carefully selected to provide hysteresis, as are the thresholds associated with the example embodiment of FIG. 8. The particular thresholds selected may be programmable by a system manufacturer, for example, and may be determined by a variety of factors such as the desired aggressiveness of the refresh control algorithm, the anticipated applications of the system of interest, the desired performance of the system and other factors.

For some embodiments, while it is desirable to avoid user-perceptible artifacts associated with transitioning between refresh rates and/or modes, for short intervals before a change in moving average EFPS is detected, if the frame rate drops below the current refresh rate, tearing may occur. Alternatively, if the frame rate exceeds the refresh rate, then fast motion may not be properly displayed.

Figure 9:
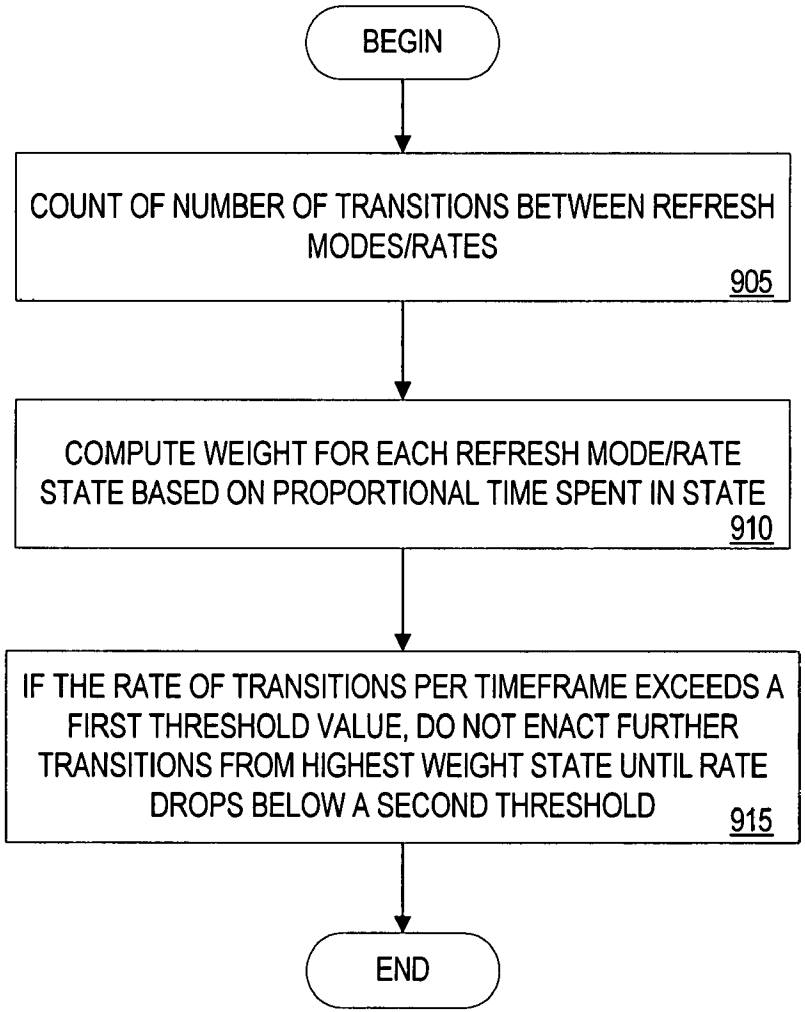
FIG. 9 is a flow diagram showing a method of one embodiment for controlling transitions between refresh rates/modes.

In an attempt to avoid the occurrence of such artifacts due to, for example, overly aggressive state transitions, for some embodiments, another algorithm may be used to supervise and govern transitions. This algorithm may be provided as part of the dynamic refresh control module 257 (FIG. 2), for example. For such embodiments, as shown in FIG. 9, a count of the number of transitions between refresh modes and/or rates is retained at block 905. At block 910, a weight is computed for each state (e.g. refresh rate and/or mode) based on the proportional time spent in that state. At block 915, if the rate of transitions per second exceeds a first threshold value, subsequent transitions from the highest weight state may not be enacted until the rate drops below a second threshold (because time passes while stuck in a particular state).

For each of these examples, where it is determined that a transition from a first refresh rate and/or mode to a second refresh rate and/or mode is to be initiated, the timing of the transition may be in accordance with the examples of FIGS. 3 and 4. For other embodiments, different timings may be used to transition between refresh rates and/or modes.

Figure 10:
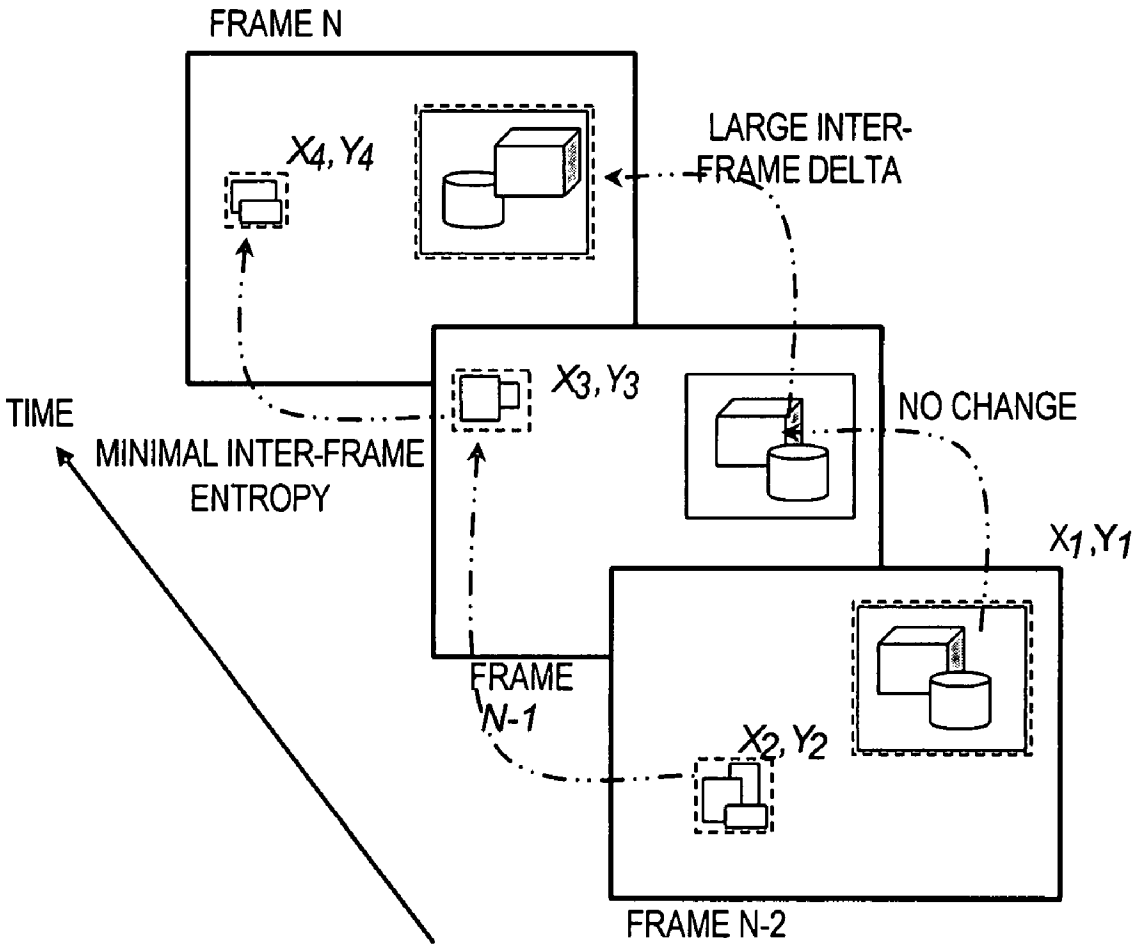
FIG. 10 is a conceptual diagram illustrating changing content across frames.
Figure 13:
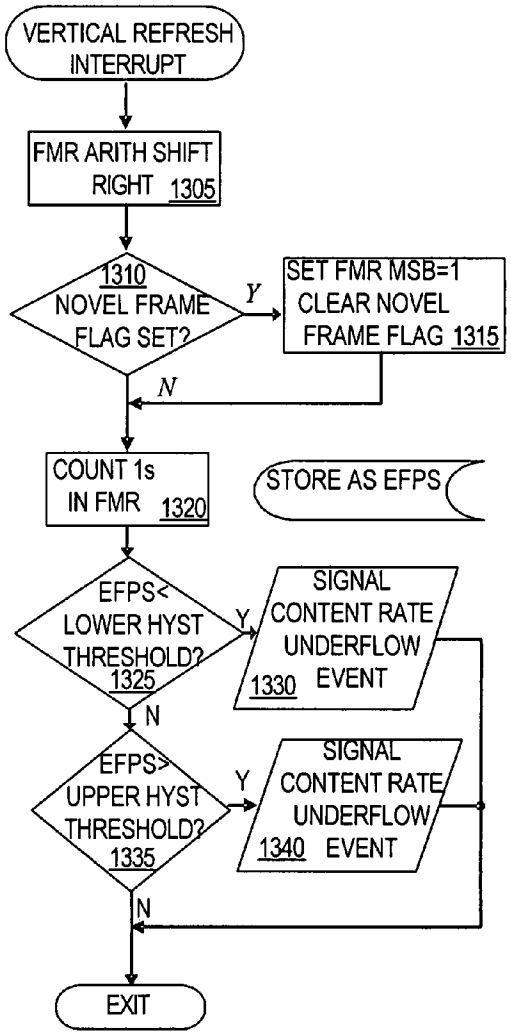
FIG. 13 is a flow diagram showing a display processing method of one embodiment that may be used to evaluate content activity.

Referring back to FIG. 6, various approaches for determining the EFPS may be used for different embodiments. For some embodiments, for example, referring to FIG. 10, significant rendering in a frame may be detected by looking at a bounded area being updated or "touched." If the bounds are significant in area (e.g. X1,Y1), or the depth of rendering in an area, or number of discrete area updates are significant, then the frame is considered "novel." For this approach, the novel frames per interval may be counted and compared to a threshold value. If significantly larger or smaller than the threshold, an event may be generated. This may be referred to as a temporal entropy detection approach using intra-frame spatial entropy.

Figure 11:
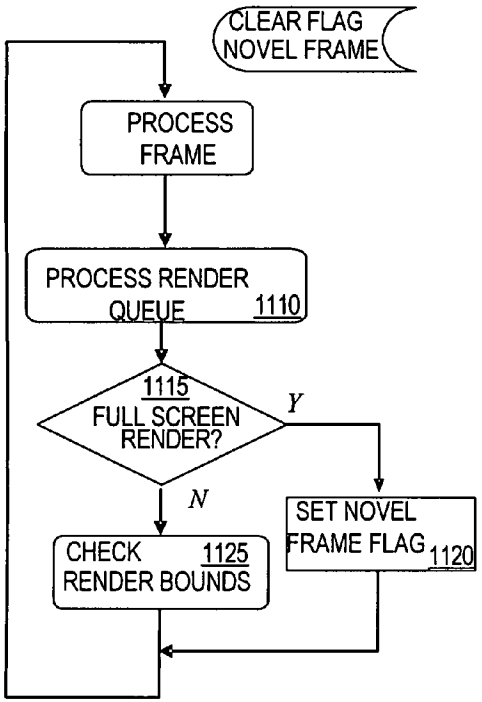
FIG. 11 is a flow diagram showing a frame rendering method of one embodiment.

FIGS. 11-14 illustrate an example of such an approach in more detail. Referring first to FIG. 11, to process a frame the render queue is processed at block 1110. At decision block 1115, if a full screen render is being performed, then at block 1120, a novel frame flag may be set. If a full screen render is not being performed, then at block 1125, the render bounds may be checked.

Figure 12:
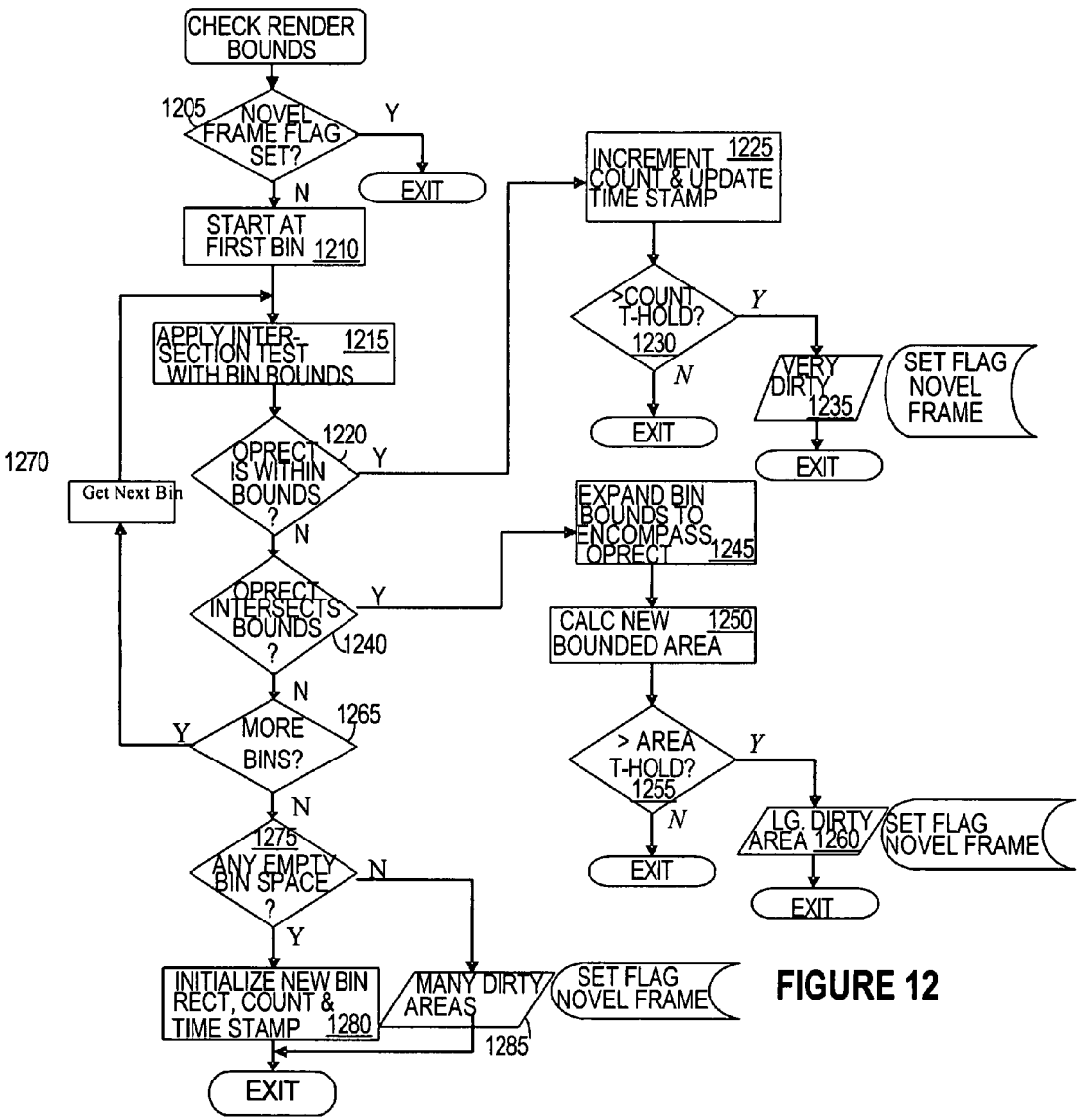
FIG. 12 is a flow diagram showing a render bounds checking process of one embodiment that may be used with the frame rendering method of FIG. 11 to evaluate content activity.

One approach that may be used to check the render bounds is illustrated and described in reference to FIG. 12. In the description that follows, the area encompassed by each operation is termed "OpRect," which is the bounded rectangle encompassing the region of pixels that will become dirty as a result of a rendering operation. These operations are grouped into "bins" that grow to encompass dirty regions grouped within certain localities.

For one embodiment, a dirty rectangle bin structure includes N-deep dirty rectangle bins for primary surface regions, a number of bins (array of bounding box arrays), array of bounding box rectangle, area, a time stamp and/or vertical refresh stamp.

The simplified structure used to record operations may appear as follows:

```
typedef struct __BOUNDING__BOX {
    RECTL        rclBounds;
    DWORD        ulArea;
    DWORD        ulOpsCount;
    DWORD        ulFirstVRefreshStamp; // VSync Count of first update
    DWORD        ulLastVRefreshStamp; // VSync Count of last update
    ULONGLONG    uqFirstTimeStamp;    // Time-stamp of first update
                 captured
    ULONGLONG    uqLastTimeStamp;     // Time-stamp of last update
```

-continued

```
} BOUNDING_BOX;
typedef struct _BOUNDING_BOX_BINS {
    BOUNDING_BOX Boxes[NUM_BINS];
} BOUNDING_BOX_BINS;
```

An update manager (not shown) in the content activity detection module 285 (FIG. 2) may include configurable parameters that may be tuned for improved performance for particular usage models. Some examples of the types of parameters that may be configured include an area threshold, a count threshold and a number of bins. For example, an area threshold may be set slightly larger than a typical 64×64 icon, the count threshold may be set to tolerate a certain number of operations in an area and a number of bins may be set to determine the number of bounded areas to keep active. Other types of parameters may be included for other embodiments.

At a high level, to check the render bounds, a process starts by looking for a matching bin (e.g. using an intersection test). One example of an intersection test that may be used for one embodiment to test if the top of the dirty rectangle list intersects the latest drawing bounds is described in the code that follows:

```
//////////////////////////////////////////////////////////////////////////////
// BOOL bIntersect
//
// If 'prcl1' and 'prcl2' intersect, has a return value of TRUE and returns
// the intersection in 'prclResult'. If they don't intersect, has a return
// value of FALSE, and 'prclResult' is undefined.
//
BOOL bIntersect(RECTL* prcl1, RECTL* prcl2, RECTL* prclResult)
{
  prclResult->left     = max(prcl1->left,     prcl2->left);
  prclResult->right    = min(prcl1->right,    prcl2->right);
  if (prclResult->left < prclResult->right)
  {
    prclResult->top      = max(prcl1->top,      prcl2->top);
    prclResult->bottom   = min(prcl1->bottom,   prcl2->bottom);
    if (prclResult->top < prclResult->bottom)
    {
      return(TRUE);
    }
  }
  return(FALSE);
}
```

If the render operation is within an existing bin, the number of operations in the bin is incremented and a time stamp is updated. If the operation count is determined to be over an operations threshold, then the bin is purged. If the render operation intersects an existing bin, a bounding box associated with the bin is expanded (e.g. using a dirty rectangle bounding box routine). An example of a dirty rectangle bounding box routine that may be used for one embodiment to create the bounding box of all intersecting rectangles is described in the following code:

```
//////////////////////////////////////////////////////////////////////////////
// LONG cBoundingBox
//
// This routine takes a list of rectangles from 'prclIn' and creates
// the rectangle 'prclBounds'. The input rectangles don't
// have to intersect 'prclBounds'; the return value will reflect the
// number of input rectangles that did fit inside the bounding box,
// and the bounding rectangles will be densely packed.
//
//  RECTL*  prclBounds
//  RECTL*  prclIn        List of rectangles
//  LONG    c             Can be zero
//
LONG cBoundingBox(RECTL* prclIn, RECTL* prclBounds, LONG c)
{
  LONG      cIntersections;
  RECTL*    prclOut;
  cIntersections    = 0;
  prclOut           = prclIn;
  for (; c != 0; prclIn++, c--)
  {
    prclOut->left     = min(prclIn->left,     prclBounds ->left);
    prclOut->right    = max(prclIn->right,    prclBounds ->right);
    if (prclOut->left < prclOut->right)
    {
      prclOut->top      = min(prclIn->top,      prclBounds->top);
      prclOut->bottom   = max(prclIn->bottom,   prclBounds->bottom);
      if (prclOut->top < prclOut->bottom)
      {
        prclOut++;
        cIntersections++;
      }
    }
  }
  return(cIntersections);
}
```

A new area is then calculated and expanded accordingly. If the area is larger than an area threshold, the bin is purged. If the render operation is outside all of the bins, an attempt is made to identify an empty bin. If one is found, then the bounding box, number of operations and time stamp are updated. If there are no empty bins, then all bins are purged. In the above, manner, when there are too many bins, or the bins are too full, too large or have not been updated for a given period of time, the bin may be purged. A bounding area check may then be performed to keep the updates relatively small. All refresh-related updates are held until the end of the refresh.

More specifically, referring to FIG. 12, at decision block 1205, it is determined whether the novel frame flag is set. If not, the process continues at block 1210 at the first bin. At block 1215, an intersection test, such as the one described above, is performed with bin-bounds and at decision block 1220, it is determined whether the area encompassed by the rendering operation (OpRect), is within bounds.

If so, then a count of the number of rendering operations and a time stamp are updated at block 1225. At decision block 1230, it is determined whether the updated count exceeds a count threshold that indicates significant content activity. If not, the process terminates and the next frame is processed (FIG. 11). If the count does exceed the count threshold, however, then the content activity is deemed to be significant and the "novel frame" flag is set (block 1235).

Referring back to decision block 1220, if the area encompassed by the rendering operation is not within bounds, then it is determined at block 1240 whether the area affected by the rendering operation intersects the bounds. If so, then at block 1245, the bin bounds are expanded to encompass the area affected by the rendering operation and at block 1250, a new bounded area is calculated. At decision block 1255, it is determined whether the new bounded area exceeds the area threshold above which significant content activity is indicated. If so, then at block 1260, the novel frame flag is set.

Referring back to decision block 1240, if the area encompassed by the rendering operation does not intersect the bin bounds, then at block 1265, it is determined whether there are more bins. If so, then at block 1270, the next bin is accessed and processing continues as described. If there are no more bins, then at block 1275, it is determined whether there is any empty bin space. If so, a new bin is initialized including the rectangular coordinates defining the current bin bounds at block 1280. The count and time stamp associated with the bin are also initialized. If there is no empty bin space, then at block 1285, significant content activity is indicated and the novel frame flag is set.

For some embodiments, the approach described above may be further expanded to compute a hash of the bounds to detect if the same drawing is repeated in every frame.

The processes described above relate to the frame rendering process. A display process including a vertical frame interrupt routine proceeds in parallel and is used to determine whether the EFPS or other measure of content activity determined in the rendering process exceeds or falls below thresholds and is also used to coordinate any changes to the refresh rate or updates to the display. An example of a vertical frame interrupt routine that may be used for some embodiments is described in reference to FIG. 13.

Figure 14:
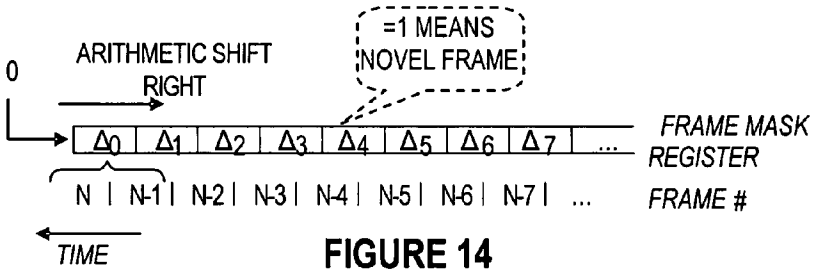
FIG. 14 is a diagram illustrating a frame mask register that may be used for one embodiment.

At block 1305, an arithmetic shift right is performed on a frame mask register. The frame mask register may be implemented in any data store of the system of interest. For one embodiment, the frame mask register may be implemented, for example, in memory-mapped I/O, in frame buffer memory (e.g. frame buffer 229 in FIG. 2) or in another location. FIG. 14 shows an example of a frame mask register structure that may be used for some embodiments.

At decision block 1310, it is determined whether the novel frame flag is set. If so, then at block 1315, the frame mask register (FMR) most significant bit (MSB) may be set to "1" and the novel frame flag may be cleared. At block 1320, the number of "1s" in the frame mask register is counted and may be stored as the Effective Frames Per Second (EFPS) or another measure of detected content activity.

At decision block 1325, it is determined whether the EFPS is less than a lower hysteresis threshold. If so, then a content rate underflow event is signaled at block 1330. If not, then it is determined at decision block 1335 whether the EFPS is greater than an upper hysteresis threshold. If so, then a content-rate overflow event is signaled at block 1340. The EFPS and signalling of a content rate underflow or overflow event may be used to determined whether or not a refresh rate adjustment is undertaken as described in reference to FIGS. 6, 7 and 8.

Figure 15:
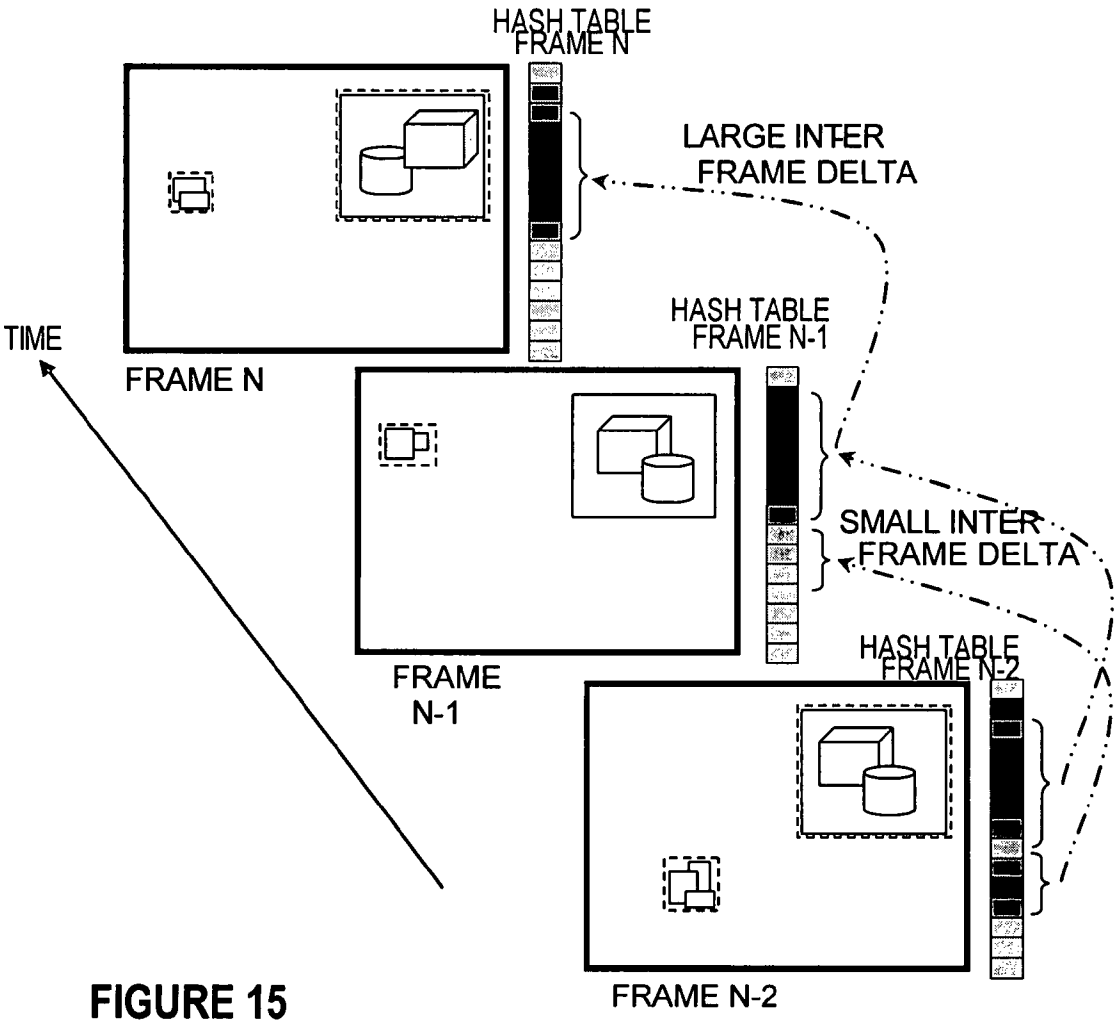
FIG. 15 is a conceptual diagram illustrating changing content across frames as evaluated by scanlines.

Referring to FIG. 15, another approach that may be used for some embodiments to determine the effective frames per second (EFPS) or detected content activity at block 605 in FIG. 6 detects a difference between scanlines of temporally adjacent frames, and if the count of temporal difference exceeds a given threshold, the frame is considered novel. Similar to the approach described in reference to FIGS. 10-14, the novel frames per interval are counted and, if they are larger or smaller than a respective threshold, an event is generated. For one embodiment, this approach may be implemented in graphics hardware such as, for example, the graphics controller 210 of FIG. 2.

Figure 17:
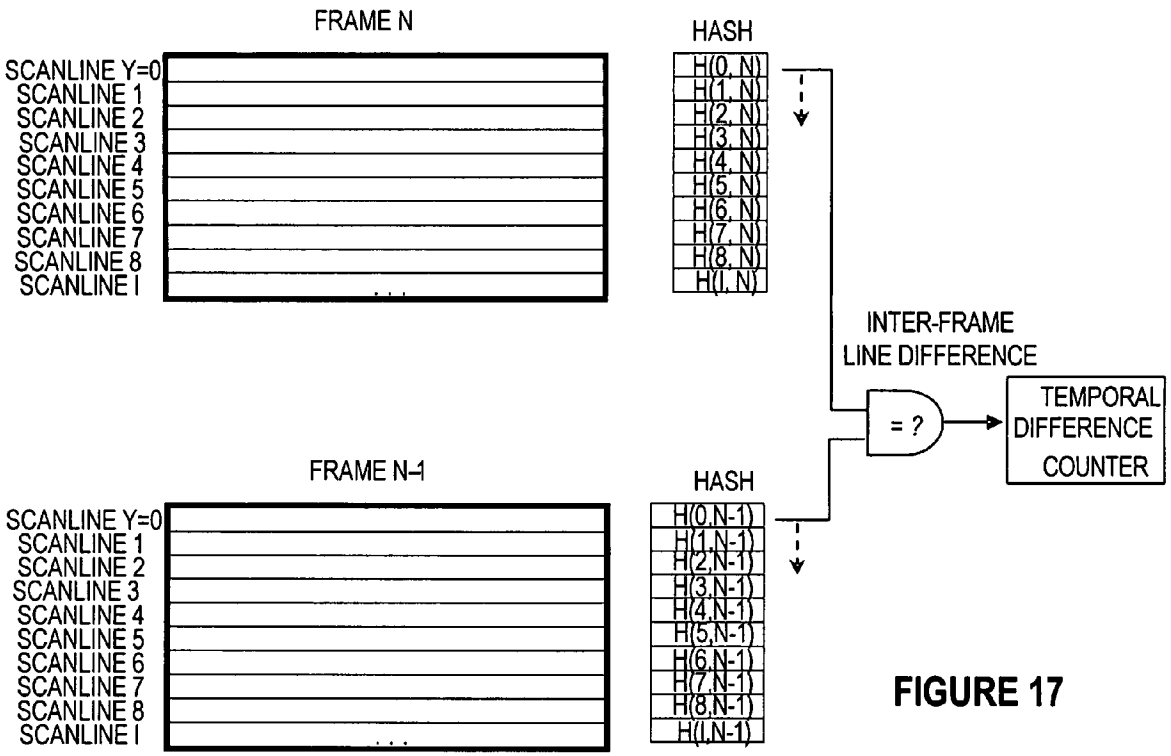
FIG. 17 is a diagram illustrating the operation of a temporal difference counter that may be used for the embodiment of FIG. 16.
Figure 16:
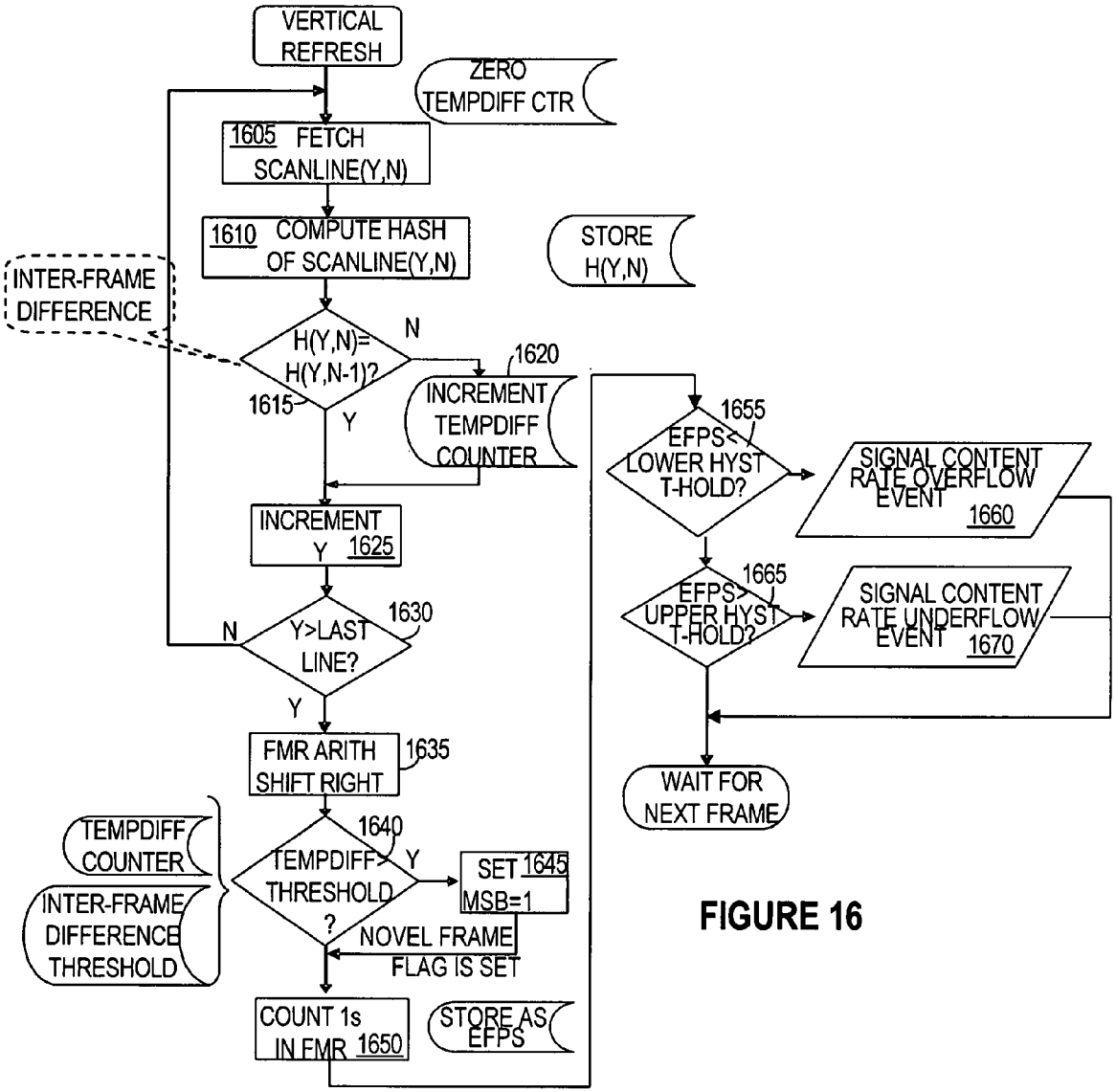
FIG. 16 is a flow diagram illustrating a display method that may be used to evaluate content activity for one embodiment.

An example of this approach is described in reference to FIGS. 16 and 17. Following a vertical refresh, a temporal difference counter (TempDiff) is zeroed and a scanline (Y, N) (where Y is the scanline and N is the frame) is fetched at block 1605. At block 1610, a hash or checksum, for example, of the scanline is computed and stored. For one embodiment, CRC32 may be used to perform the hash/checksum. It will be appreciated that for other embodiments, a different hash or checksum may be used. At decision block 1615, it is determined whether the hash of the scanline just computed is equal to a hash of the same scanline in a previous frame. If not, then at block 1620, the temporal difference counter is incremented.

At block 1625, Y is incremented and at decision block 1630, it is determined whether the last scan line has been evaluated. If not, the method continues as described until all scan lines for the frame have been similarly evaluated. If the last scanline has already been processed, then at block 1635, an arithmetic shift right operation is performed on the frame mask register, which may be configured, for example, as shown in FIG. 14, and at block 1640, it is determined whether the temporal difference counter has exceeded an inter-frame difference threshold. If so, the most significant bit of the register may be set and the novel frame flag may be set at block 1645.

At block 1650, the number of 1s in the frame mask register (indicating the effective frames per second) is counted. At decision block 1655, if the EFPS is below the lower hysteresis threshold, a content rate underflow event is initiated at block 1660. If instead, at block 1665, the EFPS is determined to exceed the upper hysteresis threshold, a content rate overflow event is initiated. The EFPS and/or content underflow or overflow information may be used to determine whether a refresh rate is to be changed.

Figure 18:
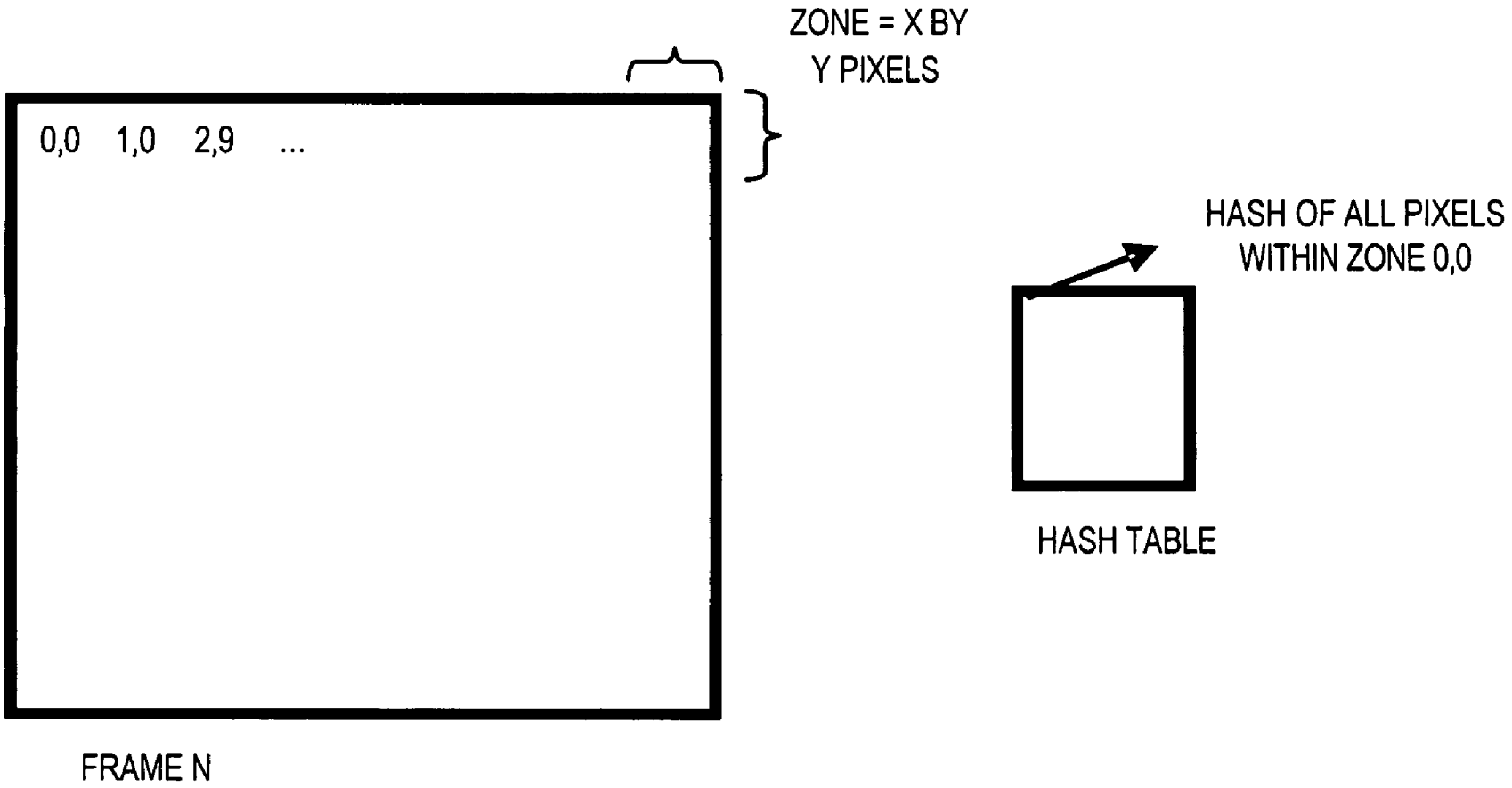
FIG. 18 is a conceptual diagram illustrating a content activity detection approach of another embodiment.

Referring to FIG. 18, for another embodiment, instead of computing and comparing a hash of corresponding scanlines as described above, a hash of one or more zones, e.g. rectangle chunks, X pixels by Y pixels in size) of the screen may be computed and compared between frames to determine effective display content activity. Such a process proceeds substantially as described in reference to FIG. 16.

While the above examples are described in reference to adjusting a refresh rate for a display that is continuously refreshed, similar approaches may be used to determine whether to perform a display refresh for displays, such as bi-stable or self-refreshing displays, that are updated more irregularly.

Thus, various embodiments of methods and apparatuses for dynamically adjusting a display refresh rate are described. In the foregoing specification, the invention has been described with reference to specific exemplary embodiments thereof. It will, however, be appreciated that various modifications and changes may be made thereto without departing from the broader spirit and scope of the invention as set forth in the appended claims For example, while specific data structures and code examples have been provided herein, it will be appreciated that different data structures and code and/or hardware may be used for other embodiments. The specification and drawings are, accordingly, to be regarded in an illustrative rather than a restrictive sense.

What is claimed is:

1. A method comprising:

accessing a policy;

detecting display content activity;

if a display is regularly refreshed, dynamically selecting a refresh rate in response to the detected display content activity and a preference indicated by the policy, wherein a change to a higher refresh rate is indicated if the detected display content activity exceeds a first threshold and a change to a lower refresh rate is indicated if the detected display content activity drops below a second threshold, and if the display is one of a bi-stable and a self-refreshing display, determining whether to refresh the display based on detected display content activity and a preference indicated by the policy;

determining a padding time;

generating a reprogramming interrupt within the padding time prior to a next vertical blank;

in response to the reprogramming interrupt, reprogramming mode timing registers to the selected refresh rate;

determining a number of transitions between each refresh state, a refresh state including a specific refresh rate and mode, computing a weight associated with each refresh state based on a proportional time spent in the refresh state, and if a rate of transitions between refresh states exceeds a third threshold value, delaying a transition from a refresh state associated with a highest weight until the state of transitions drops below a fourth threshold.

2. The method of claim 1 further comprising detecting display content activity, if the display is one of a bi-stable and a self-refreshing display, if the detected display content activity exceeds a first threshold and a display is one of a bi-stable and a self-refreshing display, indicating that the display is to be refreshed, and if the detected display content activity drops below a second threshold and the display is one of a bi-stable and a self-refreshing display, indicating that the display is not to be refreshed.

3. The method of claim 1 wherein detecting display content activity includes comparing contents of at least some display scanlines of a first frame with contents of corresponding scanlines of a second frame.

4. The method of claim 3 wherein comparing contents of at least some display scanlines of the first frame with contents of corresponding scanlines of the second frame includes computing a hash of the at least some display scanlines of the first frame and corresponding scanlines of the second frame, and comparing the hashes of the at least some display scanlines of the first frame with hashes of the coffesponding scanlines of the second frame.

5. The method of claim 4 wherein detecting display content activity further comprises maintaining a count of a number of scanlines for which a difference is detected, determining whether the count exceeds a third threshold, indicating a novel frame if the count exceeds the third threshold, and wherein determining whether the detected display content activity exceeds the first threshold includes determining a number of novel frames over a first time period.

6. The method of claim 1 further comprising if a change in refresh rate is indicated, co-ordinating the change in refresh rate to occur such at a time such that visually disturbing artifacts are substantially avoided.

7. The method of claim 1 wherein detecting display content activity includes computing a hash of a first area of display contents for a first frame;

computing a hash of a corresponding area of display contents for a second frame; and comparing the computed hashes to determine whether the amount of difference between the first and second frames is above a third threshold.

8. The method of claim 1 wherein detecting display content activity includes indicating a novel frame if one of a number of areas being rendered exceeds a third threshold, a size of an area being rendered exceeds a fourth threshold, and a number of rendering operations in an area exceeds a fifth threshold, and determining that the display content activity exceeds the first threshold if a number of novel frames over a time interval exceeds the first threshold.

9. An apparatus comprising a processor and a memory controller, the apparatus comprising: a display content activity detection module to detect display content activity, and a dynamic refresh rate control module to access a policy and to determine whether to dynamically adjust a refresh rate of a display based on detected display content activity and a preference indicated by the policy, wherein if the detected display content activity exceeds a first threshold, the dynamic refresh rate control module is to indicate a change to a higher refresh rate, and if the detected display content activity drops below a second threshold, the dynamic refresh rate control module is to indicate a change to a lower refresh rate, and wherein if a change in refresh rate is indicated, the dynamic refresh rate control module is further to determine a padding time; generate a reprogramming interrupt within the padding time prior to a next vertical blank; and in response to the reprogramming interrupt, reprogram mode timing registers to the selected refresh rate; the dynamic refresh rate control module is further to determine a number of transitions between each refresh rate, compute a weight associated with each refresh rate based on a proportional time spent at the refresh rate, and if a rate of transitions between refresh rates exceeds a third threshold value, delay a transition from a refresh rate associated with a highest weight until the rate of transitions drops below a fourth threshold.

10. The apparatus of claim 9 wherein the display content activity detection module is to compare contents of at least some display scanlines of a first frame with contents of corresponding scanlines of a second frame.

11. The apparatus of claim 10 wherein comparing contents of at least some display scanlines of the first frame with contents of corresponding scanlines of the second frame includes computing a hash of the at least some display scanlines of the first frame and corresponding scanlines of the second frame, and comparing the hashes of the at least some display scanlines of the first frame with hashes of the coffesponding scanlines of the second frame.

12. The apparatus of claim 11 wherein the display content activity detection module is further to maintain a count of a number of scanlines for which a difference is detected, determine whether the count exceeds a third threshold, indicate a novel frame if the count exceeds the third threshold, and wherein determining whether the detected display content activity exceeds the first threshold includes determining a number of novel frames over a first time period.

13. The apparatus of claim 9 wherein if a change in refresh rate is indicated, the dynamic refresh rate control module is further to co-ordinate the change in refresh rate to occur at a time such that visually disturbing artifacts are substantially avoided.

14. The apparatus of claim 9 wherein the display content activity module is to indicate a novel frame if one of a number of areas being rendered exceeds a third threshold, a size of an area being rendered exceeds a fourth threshold, and a number of rendering operations in an area exceeds a fifth threshold, and determine that the display content activity exceeds the first threshold if a number of novel frames over a time interval exceeds the first threshold.

15. A computer-readable storage medium storing instructions that, when accessed by a processor, causes the processor to access a policy;

detect a display content activity;

if a display is regularly refreshed, dynamically select a refresh rate in response to detected display content activity and a preference indicated by the policy, and if the display is one of a bi-stable and a self-refreshing display, determine whether to refresh the display based on detected display content activity and a preference indicated by the policy;

determine a padding time;

generate a reprogramming interrupt within the padding time prior to a next vertical blank; and in response to the reprogramming interrupt, reprogram mode timing registers to the selected refresh rate, determine a number of transitions between each refresh state, a refresh state including a specific refresh rate and mode, compute a weight associated with each refresh state based on a proportional time spent in the refresh state, and if a rate of transitions between refresh states exceeds a third threshold value, delay a transition from a refresh state associated with a highest weight until the state of transitions drops below a fourth threshold.

16. The computer-readable storage medium of claim 15 further storing instructions that, when accessed by a processor, causes the processor to detect display content activity, if the display is regularly refreshed, if the detected display content activity exceeds a first threshold, indicate a change to a higher refresh rate, and if the detected display content activity drops below a second threshold, indicate a change to a lower refresh rate.

17. The computer-readable storage medium of claim 15 further storing instructions that, when accessed by a processor, causes the processor to detect display content activity, if the display is one of a bi-stable and a self-refreshing display, if the detected display content activity exceeds a first threshold and a display is one of a bi-stable and a self-refreshing display, indicate that the display is to be refreshed, and if the detected display content activity drops below a second threshold and the display is one of a bi-stable and a self-refreshing display, indicate that the display is not to be refreshed.

18. The computer-readable storage medium of claim 16 wherein detecting display content activity includes comparing contents of at least some display scanlines of a first frame with contents of corresponding scanlines of a second frame.

19. The computer-readable storage medium of claim 18 wherein comparing contents of at least some display scanlines of the first frame with contents of corresponding scanlines of the second frame includes computing a hash of the at least some display scanlines of the first frame and corresponding scanlines of the second frame, and comparing the hashes of the at least some display scanlines of the first frame with hashes of the coffesponding scanlines of the second frame.

20. The computer-readable storage medium of claim 19 wherein detecting display content activity further comprises maintaining a count of a number of scanlines for which a difference is detected, determining whether the count exceeds a third threshold, indicating a novel frame if the count exceeds the third threshold, and wherein determining whether the detected display content activity exceeds the first threshold includes determining a number of novel frames over a first time period.

* * * * *

UNITED STATES PATENT AND TRADEMARK OFFICE

CERTIFICATE OF CORRECTION

PATENT NO. : 7,692,642 B2
APPLICATION NO. : 11/027113
DATED : April 6, 2010
INVENTOR(S) : David A. Wyatt It is certified that error appears in the above-identified patent and that said Letters Patent is hereby corrected as shown below:

In column 13, line 42-43, in Claim 4, delete "coffesponding" and insert -- corresponding --, therefor.

In column 13, line 55, in Claim 6, delete "co-ordinating" and insert -- coordinating --, therefor.

In column 14, line 51-52, in Claim 11, delete "coffesponding" and insert -- corresponding --, therefor.

In column 14, line 65, in Claim 13, delete "co-ordinate" and insert -- coordinate --, therefor.

In column 16, line 32-33, in Claim 19, delete "coffesponding" and insert -- corresponding --, therefor.

Signed and Sealed this

Twenty-fifth Day of May, 2010

David J. Kappos

David J. Kappos
*Director of the United States Patent and Trademark Office*